US009878548B2

(12) United States Patent
Conzelmann et al.

(10) Patent No.: US 9,878,548 B2
(45) Date of Patent: Jan. 30, 2018

(54) DIGITAL PRINTING MACHINE

(71) Applicant: HEIDELBERGER DRUCKMASCHINEN AG, Heidelberg (DE)

(72) Inventors: Daniel Conzelmann, Dielheim (DE); Wolfgang Dolz, Heidelberg (DE); Thomas Schmidt, Heidelberg (DE); Peter Thoma, Mannheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 15/297,838

(22) Filed: Oct. 19, 2016

(65) Prior Publication Data

US 2017/0106656 A1 Apr. 20, 2017

(30) Foreign Application Priority Data

Oct. 20, 2015 (DE) ..... 10 2015 220 382

(51) Int. Cl.
*B41J 2/165* (2006.01)
*B41J 11/057* (2006.01)

(52) U.S. Cl.
CPC ..... *B41J 2/16547* (2013.01); *B41J 2/16505* (2013.01); *B41J 11/057* (2013.01)

(58) Field of Classification Search
CPC ..... B41J 2/16505; B41J 2/16547; B41J 2/16523; B41J 2/16585
See application file for complete search history.

(56) References Cited

U.S. PATENT DOCUMENTS 7,311,376 B2 * 12/2007 Gast ..... B41J 2/16585 347/32
2003/0142150 A1 7/2003 Barton et al.
2008/0117253 A1 * 5/2008 Yearout ..... B41J 2/16585 347/36
2009/0122106 A1 5/2009 Ray
2010/0283816 A1 11/2010 Blackman et al.

FOREIGN PATENT DOCUMENTS

DE 19929273 A1 12/2000

* cited by examiner

*Primary Examiner* — Juanita D Jackson
(74) *Attorney, Agent, or Firm* — Laurence A. Greenberg; Werner H. Stemer; Ralph E. Locher

(57) ABSTRACT

A digital printing machine includes at least one print head for inkjet printing, a drum for transporting printing material, and a spittoon for collecting ink coming from the print head. The drum has a mounting for the spittoon. The spittoon includes a support and an absorber fixed thereto. The absorber is quasi flush with the outer circumference of the drum, and the support and the absorber together form a replaceable disposable unit. A spittoon for use in a digital printing machine is also provided.

9 Claims, 7 Drawing Sheets

DIGITAL PRINTING MACHINE

CROSS-REFERENCE TO RELATED APPLICATION

This application claims the priority, under 35 U.S.C. § 119, of German application DE 10 2015 220 382.4, filed Oct. 20, 2015; the prior application is herewith incorporated by reference in its entirety.

BACKGROUND OF THE INVENTION

Field of the Invention

The present invention relates to a digital printing machine including at least one print head for inkjet printing and a spittoon for collecting ink coming from the print head. The invention further relates to a disposable spittoon.

U.S. patent application U.S. 2008/0117253 A1 discloses a digital printing machine including a spittoon with a housing. The housing contains an absorber and a roller. When the spittoon is filled to capacity, it is replaced by a new one. Due to the complex structure including the roller it is to be assumed that the contaminated spittoon that has been removed from the digital printing machine is cleaned and subsequently reinserted. The spittoon is not a disposable spittoon but a reusable spittoon.

SUMMARY OF THE INVENTION

It is accordingly an object of the invention to provide a low-maintenance digital printing machine and a spittoon suitable for such a printing machine, which overcome the hereinafore-mentioned disadvantages of the heretofore-known machines and spittoons of this general type.

With the foregoing and other objects in view there is provided, in accordance with the invention, a digital printing machine, comprising a minimum of one print head for inkjet printing, a drum for transporting printing material, and a spittoon for collecting ink coming from the print head. The drum has a mounting for the spittoon, the spittoon has a support and an absorber fixed thereto, the absorber is quasi flush with the outer circumference of the drum, and the support and the absorber together form a replaceable disposable unit.

In a further development of the digital printing machine of the invention, the support is a housing in the form of a U-profile bar, the U profile having a bottom and side walls, the side walls having ends connected to the bottom and free ends. In another development, the mounting has hooks of a rib-shaped structure and the free ends of the side walls are in contact with the hooks when the spittoon is inserted in the mounting. In a further development, the mounting has an eccentric shaft or a different type of adjustable clamping element for clamping the spittoon. The adjustable clamping element may, for instance, be a multi-function slide rod. In an added development, the mounting includes a slide rod for moving the spittoon and the slide rod extends in a direction parallel to the spittoon when the spittoon is inserted in the mounting. In an additional development the mounting has a spring for pressing the slide rod against the support when the spittoon is clamped. In yet another development the slide rod has control cams for adjusting the slide rod in a direction perpendicular to the spittoon.

In yet a further development the printing material is a sheet and the drum is a sheet-transporting drum. In yet an added development the sheet-transporting drum has a gripper system for clamping and holding the sheet and a cylinder gap, the gripper system is disposed in the cylinder gap, and the mounting and the spittoon are disposed in the same cylinder gap as the gripper system.

With the objects of the invention in view, there is also provided a disposable spittoon that is suitable for use in the digital printing machine of the invention or in a digital printing machine in accordance with one of the further developments of the invention, the disposable spittoon comprising a support and an absorber disposed thereon, wherein the support and the absorber together form a replaceable disposable unit.

In another development of the spittoon of the invention the support is embodied as a housing having an ink collection opening and the absorber extends at least as far as the ink collection opening.

In a further development the housing is a U profile bar having an interior that is bounded by a bottom and by side walls, and the absorber fills the cross-section of the interior in a quasi complete way. In an added development the side walls have ends connected to the bottom and free ends and the absorber is flush with the free ends or protrudes beyond the free ends. In an additional development the bottom of the U profile bar is embodied as a clamping spring for clamping the spittoon. In a concomitant development the support is a four-edge rod and the absorber is bonded to the support by gluing or in any other way.

Other features which are considered as characteristic for the invention are set forth in the appended claims.

Although the invention is illustrated and described herein as embodied in a digital printing machine and a disposable spittoon, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
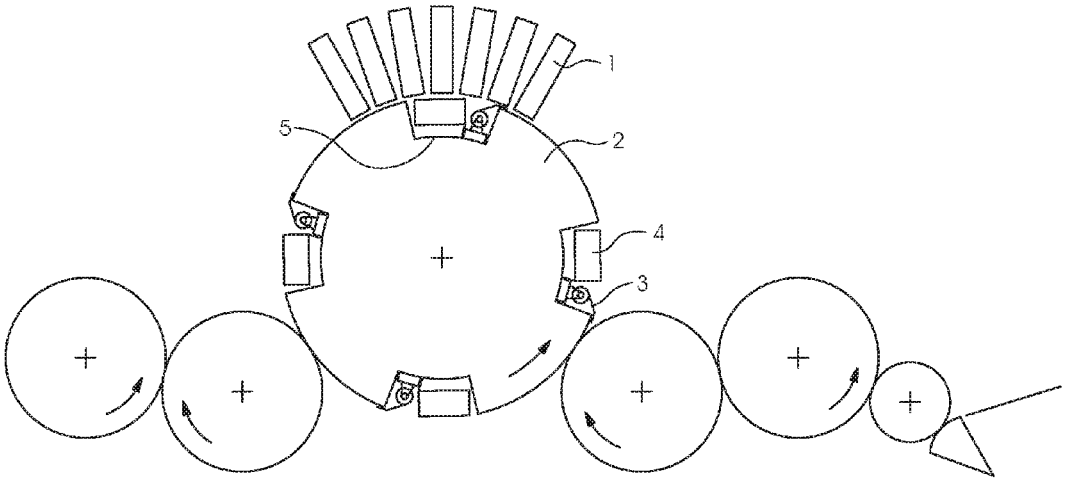
FIG. 1 is a longitudinal-sectional view of a digital printing machine with inkjet print heads and a sheet-transporting drum.

Referring now to the figures of the drawings in detail and first, particularly, to FIG. 1 thereof, there is seen a digital printing machine including print heads 1 for inkjet printing.

The print heads 1 are directed towards a drum 2. The drum 2 has cylinder gaps 5 with grippers 3 and collecting devices 4 disposed therein. The grippers 3 form a gripper system in the respective cylinder gap 5 to hold the sheets to be printed. The collecting devices 4 are provided to collect the drops of ink that the print heads 1 emit to clear their nozzles.

Figure 2:
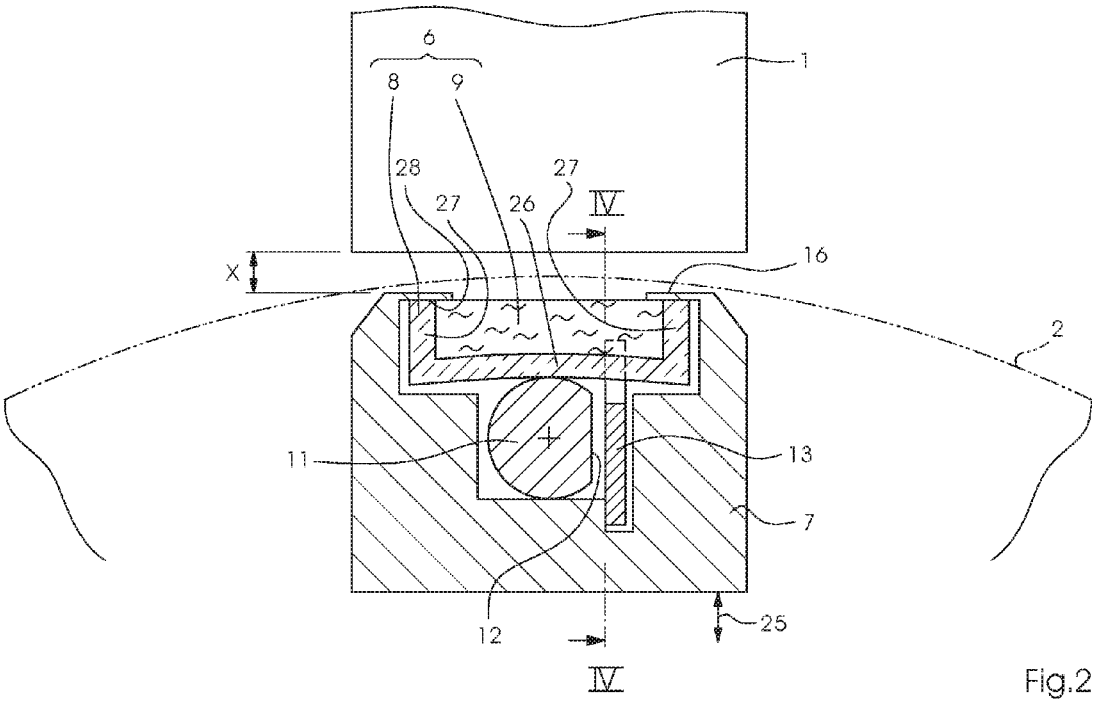
FIG. 2 is a cross-sectional view of a first exemplary embodiment of a collecting device of the sheet-transporting drum of FIG. 1.

FIG. 2 illustrates a collecting device 4 including a spittoon 6 and a mounting 7. The spittoon 6 extends over the entire printing width of the respective print head 1 and includes a support 8 and an absorber 9 for absorbing the collected ink drops. The support 8 may be referred to as a housing 8 of the spittoon 6 or, due to its shape, as a bar 8. The bar 8 has a U-shaped profile and is open towards the top (i.e. towards the circumference of the drum). The housing or bar 8 has a bottom 26, side walls 27 with free ends 28 and an ink collection opening 10 in between. The absorber 9 is formed of felt or foam material or any other type of capillary or porous absorbent material and is inserted into the bar 8 as a filler. The absorber 9 extends in a direction perpendicular to the plane of the drawing of FIG. 2 and over the entire printing width of the print heads 1. The bar 8 is a plastic bar and has an elastic bottom in contact with an eccentric shaft 11 during clamping. The clamping force is generated by the inherent elasticity of the bar 8. If the bar 8 is not sufficiently elastic, the eccentric shaft 11 may be spring-mounted in order to be pressed against the bar 8 by one or more springs when in the clamping position.

The mounting 7 is a profiled bar with an interior having an upper opening. The interior is furthermore open towards at least one bar end, allowing the spittoon 6 to be pulled out of the mounting 7 in a longitudinal direction thereof. The interior includes a wide upper section, a narrower lower section, and a groove. The spittoon 6 is inserted in the upper section. The eccentric shaft 11 is inserted in the lower section. With the exception of a flat section 12, the eccentric shaft 11 has a circular profile. The eccentric shaft 11 may also be referred to as a clamping element for clamping the spittoon 6. The groove acts as a linear guide for a slide rod 13. One end of the slide rod 13 has a protrusion 14 (FIG. 4) and the other end of the slide rod 13 has an angled section 15 (FIG. 3) acting as a handle. The ink collection opening 10 of the mounting 7 is bounded by mutually opposing border strips that form hooks 16 in the profile of the mounting 7. The hooks 16 are very thin and may be referred to as ribs or tabs. The free ends 28 of the arms or side walls 27 of the bar 8 and the absorber 9 are in contact with the hooks 16, securing the spittoon 6 against falling out of the upper opening of the mounting 7 and additionally securing the absorber 9 against falling out of the bar 8. Thus, the absorber 9 does not necessarily have to be glued thereto. The securing effect is effective even at high rotational speeds of the drum 2 and resultant high centrifugal forces.

When the absorber 9 is not yet saturated with ink, the upper surface of the absorber 9 facing the print head 1 is flush with the ends of the two arms of the bar 8. An adjustment device 25, which is only schematically indicated, allows the mounting 7 to be adjusted in a radial direction relative to the drum 2 to set a distance X between the top side of the absorber 9 and a nozzle plate of the print head 1. The distance X ranges from 0.5 mm to 3.0 mm, preferably from 1 mm to 2 mm.

Figure 3:
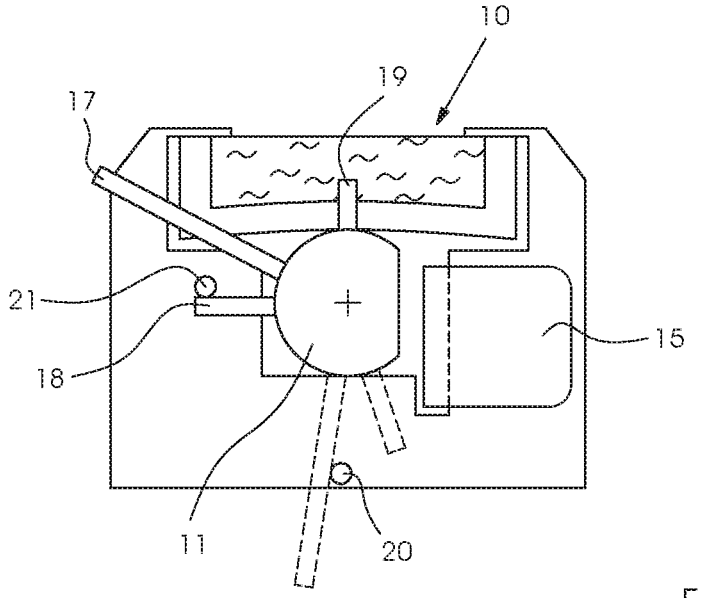
FIG. 3 is a side-elevational view of the collecting device of FIG. 2.

FIG. 3 illustrates a first cross pin 17, a second cross pin 18, and a third cross pin 19 inserted in the eccentric shaft 11. The first cross pin 17 acts as a handle for rotating the eccentric shaft 11 and hits a first stop 20, which consequently limits the angle of rotation of the eccentric shaft 11 in one direction of rotation. The second cross pin 18 hits a second stop 21, which consequently limits the angle of rotation of the eccentric shaft 11 in the other direction of rotation. The third cross pin 19 forms a bar that prevents the spittoon 6 from being pulled out of the mounting 7 when the eccentric shaft 11 has been rotated into the clamping position.

Figure 4:
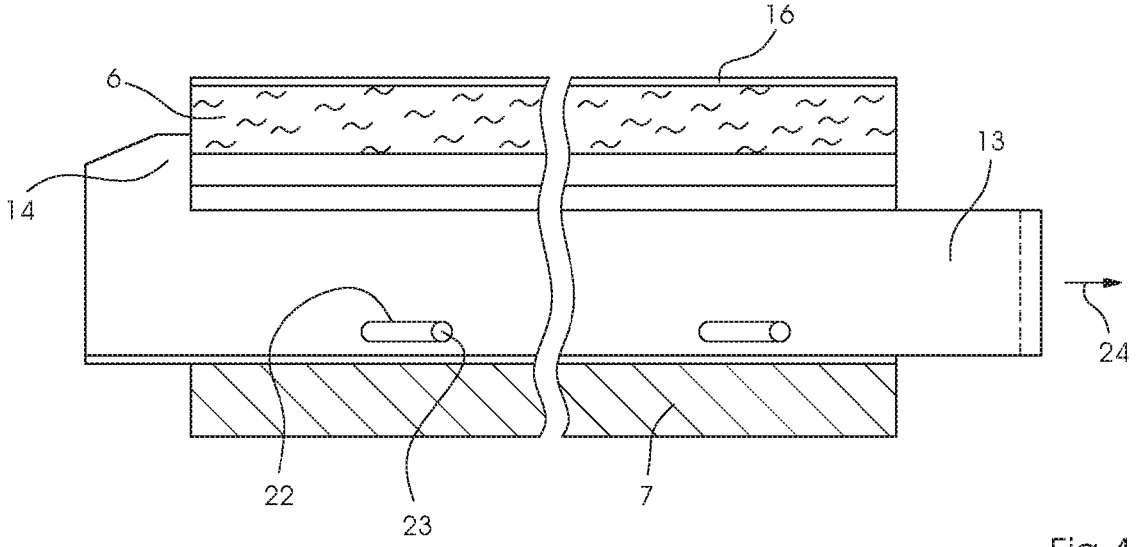
FIG. 4 is a longitudinal-sectional view of the collecting device of FIG. 2.

FIG. 4 illustrates the slide rod 13 having elongated holes or slots 22 and slide pins 23. The slide pins 23 engage in the elongated holes 22 and are firmly positioned in the mounting 7. The slide pins or stop pins 23 limit the movements of the slide rod 13 in a direction 24 and in the opposite direction. The protrusion 14 passes beyond the spittoon 6 when the latter is inserted in the mounting 7.

A tool-free exchange of the spittoon 6 is carried out as follows: The filling of the bar 8 including the absorber 9 is dimensioned in such a way that the absorber 9 swells when it has absorbed the maximum possible amount of ink. A (non-illustrated) sensor that is present anyway to monitor the traveling of the sheets, known as the "bad sheet sensor," may additionally be used to detect the swelling of the absorber and may thus realize when the top of the absorber 9 has risen past the acceptable level corresponding to the distance X. An electronic control unit connected not only to the sensor, but also to the adjustment device 25 knows the setting of the mounting 7. Based on the measurements of the sensor in terms of the distance X and on the setting of the adjustment device 25, the control unit may determine or calculate the filling level of the absorber 9 and, when a threshold is exceeded, send out an optical or acoustic signal to alert the operator of the impending need for a spittoon change.

When the absorber 9 is saturated with ink, the entire spittoon 6, which is disposable, is disposed of and replaced by a new spittoon 6. It is not only the absorber 9 that is removed from the digital printing machine but also the bar 8 that stabilizes and partly encapsulates the absorber 9. In contrast to removing only the absorber 9, the removal of the absorber 9 together with the bar 8 is an easy-maintenance feature because it may quickly be carried out without any risk of contaminating the machine. The collecting device 4 is thus suitable for an industrial operation of the digital printing machine because an industrial operation requires the spittoon 6 to be changed at frequent intervals, e.g. once every shift. In order to remove the spittoon 6 from the mounting 7, the first step is to release the clamping effect by rotating the eccentric shaft 11 in an angular position in which its flat section 12 faces the spittoon 6. In this angular position, the spittoon 6 is relaxed and the third cross pin 19 frees the spittoon 6 to carry out a longitudinal movement out of the mounting 7. For this purpose, the operator pulls the slide rod 13 in the direction 24 at the angled section 15, causing the protrusion 14 to apply pressure to the bar 8 and causing the slide rod 13 to push the spittoon 6 far enough out of the mounting 7 for an operator to grasp the spittoon 6 on the side of the bar 8 in a convenient and secure way and subsequently to pull it completely out of the mounting 7 by hand.

When the new spittoon 6 is inserted into the mounting 7, the spittoon 6 hits the protrusion 14, causing the slide rod 13 to be entrained and moved back into the mounting 7. In this process, every elongated hole 22 slides from one end thereof to the other end thereof on the respective stop pin 23. When the other ends of the elongated holes 22 are in contact with the stop pins 23, the protrusion 14 acts as an end stop for the spittoon 6. If the spittoon 6 has not been fully inserted into the mounting 7, the third cross pin 19 hits the bar 8 when the eccentric shaft 11 is rotated into its clamping position, blocking any further rotation of the eccentric shaft 11 into the clamping position and preventing the spittoon 6 that has not been fully inserted from axially locking and the bar 8 from being properly clamped between the hooks 16 and the eccentric shaft 11.

Leaf springs may be provided in the mounting 7 as an emergency measure for a case in which such a faulty locking remains undetected for any length of time. These leaf springs press the spittoon 6 against the hooks 16 to prevent it from inadvertently sliding out of the mounting 7. The leaf springs may be disposed in the mounting 7 on the end thereof opposite the operating elements.

Figure 5A:
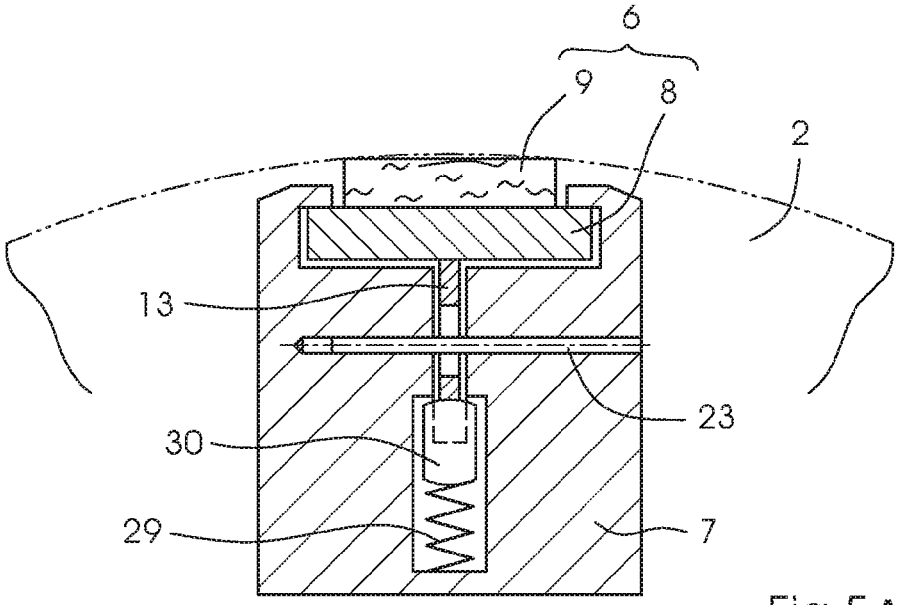
FIGS. 5A-5C illustrate a second embodiment of a collecting device of the sheet-transporting drum of FIG. 1 with the collecting device ready to operate.
Figure 6A:
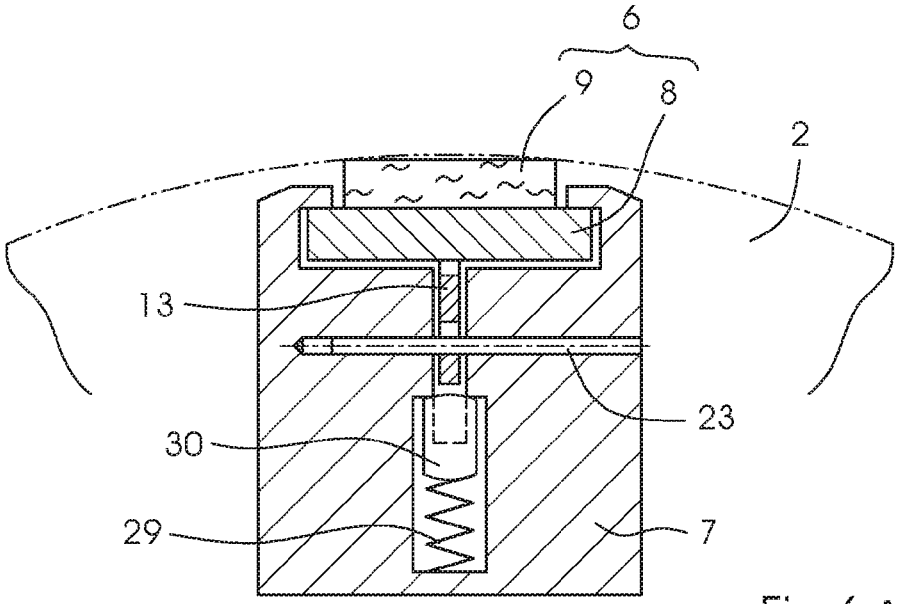
FIGS. 6A-6C illustrate the collecting device of the second embodiment ready for the spittoon to be replaced.
Figure 5B:
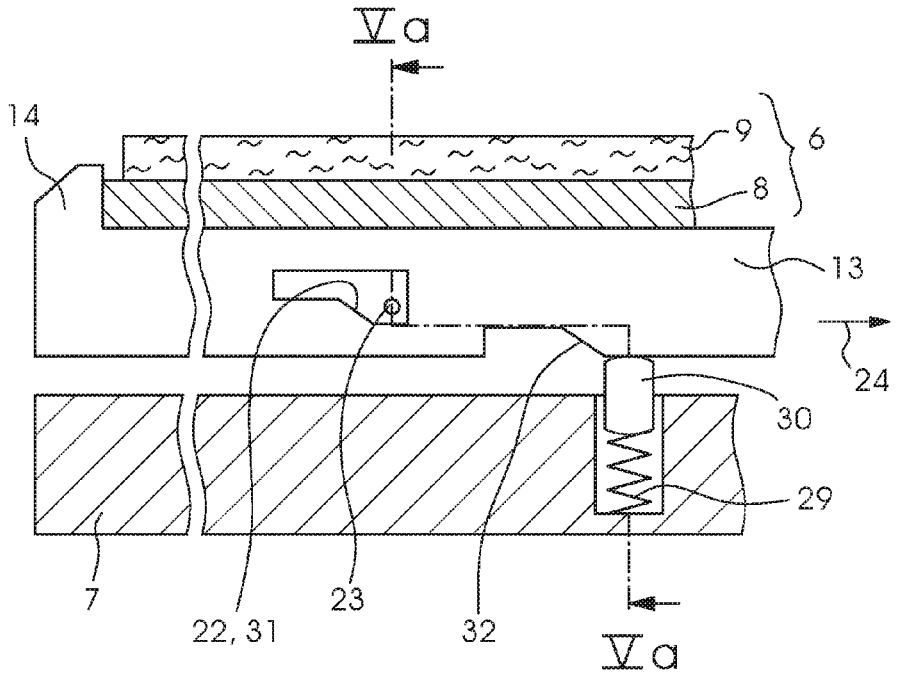
Figure 6B:
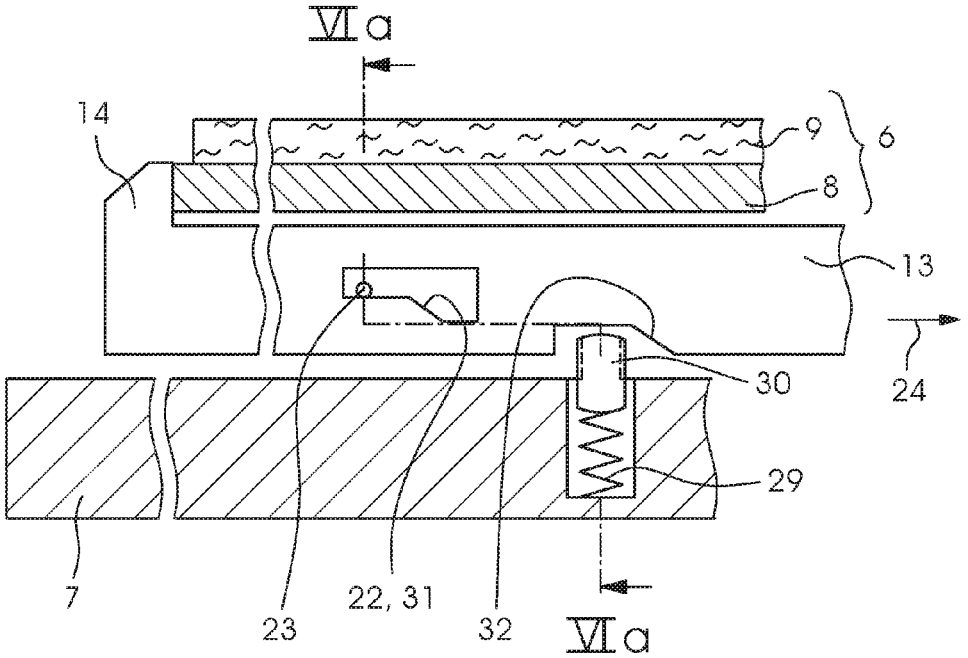
Figure 5C:
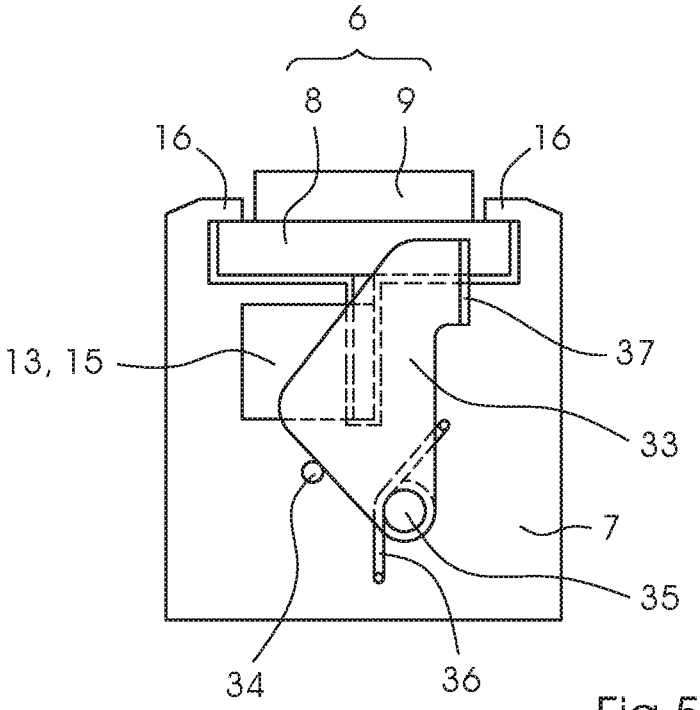
Figure 6C:
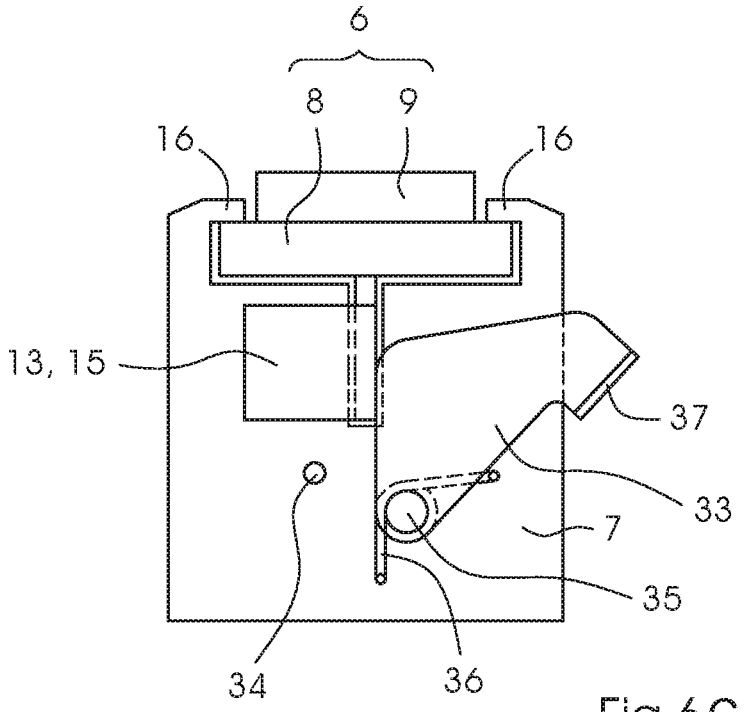

FIGS. 5A to 6C illustrate a second exemplary embodiment of the collecting device 4. Components that have identical functions in the first exemplary embodiment and in the second exemplary embodiment have the same reference symbols as in FIGS. 1 to 4. FIG. 5A is a sectional view taken along a sectional line Va-Va of FIG. 5B. FIG. 5C is a side view of the collecting device 4 corresponding to the cross-sectional view of FIG. 5A and the longitudinal sectional view of FIG. 5B. FIG. 6*a* is a sectional view taken along a sectional line VIa-VIa of FIG. 6B. FIG. 6C is a side view of the collecting device 4 corresponding to the cross-sectional view of FIG. 6A and the longitudinal sectional view of FIG. 6B. FIGS. 5A to 5C illustrate the collecting device 4 with the spittoon 6 clamped and locked in the mounting 7. In this state, the absorber 9 is quasi flush or substantially flush or approximately flush with the outer circumference of the drum 2 (indicated in phantom lines). FIGS. 6A to 6C illustrate the collecting device 4 in a setting in which the spittoon 6 is no longer clamped and is thus unlocked.

In the second exemplary embodiment in accordance with FIGS. 5A to 6C, the support 8 is embodied as a bar with a flat four-edge profile and the absorber 9 is a fleece tape. The support 8 and the absorber 9 are firmly bonded to one another by a double-faced adhesive tape and together form a replaceable disposable unit. The support 8 and the absorber 9 have approximately the same thickness. The absorber 9 is narrower than the support 8. Thus, the support 8 has border strips that protrude beyond the absorber 9 on both sides as shown in FIG. 5A.

In the second exemplary embodiment, the hooks 16 of the mounting 7 are thicker than in the first exemplary embodiment. When the spittoon 6 is clamped, the hooks 16 are in contact with the support 8 but not with the absorber 9, which protrudes from the mounting between the hooks 16. The eccentric shaft 11 that is provided in the first exemplary embodiment (FIGS. 2 to 4) is missing in the second exemplary embodiment because in the second embodiment, the slide rod 13 advantageously additionally acts as a clamping element for clamping the spittoon 6. In contrast to the first exemplary embodiment in which the support 8 itself acts as a clamping spring, the second exemplary embodiment includes springs 29 for generating the clamping force. One spring 29 is shown in the drawing. The springs 29 are compressible coil springs disposed in a respective blind bore. One end of a respective spring 29 is supported on the bottom of the blind bore and the other spring end is supported on a pressure element 30, for instance a spring bolt. The blind bores are disposed in the mounting 7. The mounting 7 further includes a central longitudinal slot in which the slide rod 13 is disposed and guided. At the bottom, the longitudinal slot merges into a longitudinal groove accommodating and guiding the support 8. The longitudinal slot and the longitudinal groove together form a T-shaped hollow profile in the interior of the mounting 7.

Like the slide rod 13 of the first exemplary embodiment, the slide rod 13 of the second exemplary embodiment has multiple elongated holes or slots 22. FIGS. 5B and 6B only show a section of the slide rod 13 with one elongated hole 22. Every elongated hole 22 has a narrow section and a wide section that merge in an inclined section. The inclined section forms a first control cam 31. The stop pins 23 additionally act as cam followers interacting with the first control cams 31. When the slide rod 13 is pulled in the direction 24, the stop pins 23, through the use of the first control cams 31, push the slide rod 13 downward into the mounting 7, away from the spittoon 6. Recesses ending in an inclined section are formed in the lower border of the slide rod 13. Second control cams 32 form the inclined sections of the recesses. When the slide rod 13 is displaced counter to the direction 24, the pressure elements 30, acting through the second control cams 32, press the slide rod 13 upward against the spittoon 6, thus clamping the spittoon 6. The pressure elements 30 act as cam followers interacting with the second control cams 32. When the spring-mounted pressure elements 30 press the slide rod 13 against the support 8, there is a clearance (air) between the stop pin 23 and the pressure element 30-side of the inner wall (the lower side in FIG. 5B) of the respective elongated hole 22 or the wide section thereof as shown in FIG. 5B.

A pawl 33 is disposed on one end of the mounting 7 for rotation about an axis 35. A hinge spring 36 is disposed on the axis 35. One arm of the hinge spring 36 is supported on the mounting 7 and the other arm is supported on the pawl 33. The hinge spring 36 is pre-loaded and strives to rotate the pawl 33 in a counter-clockwise direction with reference to FIGS. 5C and 6C. A pin firmly positioned in the mounting 7 acts as a stop 34 that limits the angle of rotation of the pawl 33. When the pawl 33 is in contact with the stop 34, the pawl 33 blocks the slide rod 13 and the spittoon 6. Then the pawl 33 prevents the spittoon 6 and the slide rod 13 from being pulled out or from falling out of the mounting 7 in the direction 24 (see FIGS. 5B and 6B). During a printing operation, the protrusion 14 (see FIG. 4) secures the spittoon 6 against axial displacement on one end and the pawl 33 secures the spittoon 6 against axial displacement on the other end. The pawl 33 has an angled portion acting as a handle 37 on an end opposite the axis 35. The operator uses the handle 37 to pivot the pawl 33 in a clockwise direction in order for the pawl 33 to allow the slide rod 13 and the spittoon 6 to move in the direction 24. In the second exemplary embodiment, the spittoon 6 is pulled out by using the slide rod 13 and the protrusion 14 thereof in the same way as in the first exemplary embodiment. When the operator has pulled out the slide rod 13 past the pawl 33, the operator may release the pawl 33. The pawl 33 is then readjusted in a counter-clockwise direction by the hinge spring 36 and enters into contact with the slide rod 13 as shown in FIG. 6C. In this process, the right-hand flat side of the slide rod 13 in FIG. 6C acts as a stop for the pawl 33.

The invention claimed is:

1. A digital printing machine, comprising:

at least one print head for inkjet printing;

a spittoon for collecting ink coming from said at least one print head; and a drum for transporting printing material, said drum having a mounting for said spittoon and said drum having an outer circumference;

said mounting having a slide rod for moving said spittoon, said slide rod extending in a direction parallel to said spittoon when said spittoon is inserted in said mounting;

said spittoon including a support and an absorber disposed on said support, said absorber being quasi flush with said outer circumference of said drum, and said support and said absorber together forming a replaceable disposable unit.

2. The digital printing machine according to claim 1, wherein said support has a housing formed as a U-shaped profile bar with a bottom and side walls, said side walls having ends connected to said bottom and free ends.

3. The digital printing machine according to claim 2, wherein said mounting has hooks with a rib-shaped structure, and said free ends of said side walls are in contact with said hooks when said spittoon is inserted in said mounting.

4. The digital printing machine according to claim 1, wherein said mounting uses an eccentric shaft, said slide rod, or an adjustable clamping element for clamping said spittoon.

5. The digital printing machine according to claim 1, wherein said mounting has a spring for pressing said slide rod against said support when clamping said spittoon.

6. The digital printing machine according to claim 1, wherein said slide rod has control cams for adjusting said slide rod in a direction perpendicular to said spittoon.

7. The digital printing machine according to claim 1, wherein said drum is a sheet-transporting drum for transporting a sheet as the printing material.

8. The digital printing machine according to claim 7, wherein:

said sheet-transporting drum has a cylinder gap;

said sheet-transporting drum has a gripper system disposed in said cylinder gap for clamping and holding the sheet; and said mounting and said spittoon are disposed in said cylinder gap along with said gripper system.

9. The digital printing machine according to claim 1, wherein said slide rod is configured to be pulled by an operator causing said slide rod to push said spittoon far enough out of said mounting for the operator to grasp said spittoon and pull said spittoon completely out of said mounting by hand.

* * * * *